US008493229B2

(12) United States Patent
Olson et al.

(10) Patent No.: US 8,493,229 B2
(45) Date of Patent: Jul. 23, 2013

(54) VERBAL WARNING SYSTEMS AND OTHER AUDIBLE WARNING SYSTEMS FOR USE WITH VARIOUS TYPES OF DEVICES, CONTAINERS, PRODUCTS AND OTHER THINGS

(71) Applicant: Vesstech, Inc., Brier, WA (US)

(72) Inventors: Josiah N. Olson, Las Vegas, NV (US); Marty Olson, Brier, WA (US)

(73) Assignee: Vesstech, Inc., Brier, WA (US)

( * ) Notice: Subject to any disclaimer, the term of this patent is extended or adjusted under 35 U.S.C. 154(b) by 0 days.

(21) Appl. No.: 13/626,750

(22) Filed: Sep. 25, 2012

(65) Prior Publication Data

US 2013/0073290 A1 Mar. 21, 2013

Related U.S. Application Data

(62) Division of application No. 12/830,071, filed on Jul. 2, 2010, which is a division of application No. 11/855,990, filed on Sep. 14, 2007, now Pat. No. 7,772,986.

(60) Provisional application No. 60/845,454, filed on Sep. 18, 2006.

(51) Int. Cl.
*G08B 25/08* (2006.01)

(52) U.S. Cl.
USPC ..... 340/692; 340/691.6

(58) Field of Classification Search
USPC ..... 340/692, 568.1, 691.6, 545.6, 540, 340/686.6, 531, 384.1, 545.3, 815.4; 381/104; 206/216; 283/79, 81; 368/89
See application file for complete search history.

(56) References Cited

U.S. PATENT DOCUMENTS

| | | | |
|---|---|---|---|
| 3,310,793 | A | 3/1967 | Takarabe et al. |
| 3,811,532 | A | 5/1974 | Everitt |
| 4,242,670 | A | 12/1980 | Smith |
| 4,255,745 | A | 3/1981 | Rohan et al. |
| 4,426,691 | A | 1/1984 | Kawasaki et al. |
| 4,607,747 | A | 8/1986 | Steiner et al. |
| 4,617,556 | A | 10/1986 | Rivera et al. |
| 4,688,023 | A | 8/1987 | McGill et al. |
| 4,911,320 | A | 3/1990 | Howes |
| 4,934,079 | A | 6/1990 | Hoshi |

(Continued)

FOREIGN PATENT DOCUMENTS

WO WO-2006016316 A1 2/2006

OTHER PUBLICATIONS

U.S. Appl. No. 13/626,764, filed Sep. 25, 2012, Olson et al.
U.S. Appl. No. 13/626,781, filed Sep. 25, 2012, Olson et al.

(Continued)

*Primary Examiner* — Toan N Pham
(74) *Attorney, Agent, or Firm* — Perkins Coie LLP

(57) ABSTRACT

Verbal warning labels and other audible warning systems for use with different devices, containers, products and other things in various environments are disclosed herein. An audible warning system configured in accordance with an embodiment of the invention includes a device having a standardized textual warning associated therewith, and a sound playback system operably coupled to the device. The sound playback device can be configured to audibly output a verbal warning corresponding to the textual warning. The verbal warning can be provided by at least one of a manufacturer, supplier, distributor or retail vendor of the device, and the verbal warning can supplement or replace the standardized textual warning.

12 Claims, 10 Drawing Sheets

U.S. PATENT DOCUMENTS

| | | | | |
|---|---|---|---|---|
| 5,056,659 | A | 10/1991 | Howes et al. | |
| 5,063,698 | A | 11/1991 | Johnson et al. | |
| 5,099,232 | A | 3/1992 | Howes | |
| 5,130,696 | A | 7/1992 | Liebman | |
| 5,275,285 | A | 1/1994 | Clegg | |
| 5,281,952 | A | 1/1994 | Dragan et al. | |
| 5,283,567 | A | 2/1994 | Howes | |
| 5,289,917 | A | 3/1994 | Chabria | |
| 5,365,219 | A | 11/1994 | Wong et al. | |
| 5,379,886 | A | 1/1995 | Brauner et al. | |
| 5,439,103 | A | 8/1995 | Howes | |
| 5,464,092 | A | 11/1995 | Seeley | |
| 5,577,918 | A | 11/1996 | Crowell | |
| 5,710,422 | A | 1/1998 | Clark | |
| 5,728,415 | A | 3/1998 | Troska et al. | |
| 5,761,836 | A | 6/1998 | Dawson et al. | |
| 5,762,194 | A | 6/1998 | Clegg | |
| 5,796,328 | A | 8/1998 | Golant | |
| 5,806,707 | A | 9/1998 | Boehm et al. | |
| 5,819,976 | A | 10/1998 | Boehm et al. | |
| 5,886,621 | A | 3/1999 | Clark | |
| 5,894,275 | A | 4/1999 | Swingle | |
| 5,903,869 | A | 5/1999 | Jacobson et al. | |
| 5,923,242 | A | 7/1999 | Slagle et al. | |
| 5,939,983 | A | 8/1999 | Rudell et al. | |
| 5,971,195 | A | 10/1999 | Reidinger et al. | |
| 5,992,629 | A | 11/1999 | Gullord et al. | |
| 6,032,820 | A | 3/2000 | Ladina et al. | |
| 6,056,116 | A | 5/2000 | Troska | |
| 6,104,306 | A | 8/2000 | Hogue et al. | |
| 6,298,990 | B1 | 10/2001 | Amrod et al. | |
| 6,339,371 | B1 | 1/2002 | Baggelaar et al. | |
| 6,418,283 | B1 | 7/2002 | Wegman et al. | |
| 6,470,653 | B1 | 10/2002 | Lutz et al. | |
| 6,486,788 | B1 * | 11/2002 | Zagone et al. | 340/686.1 |
| 6,523,285 | B1 | 2/2003 | Gilson et al. | |
| 6,559,768 | B2 | 5/2003 | Schaffner et al. | |
| 6,637,906 | B2 | 10/2003 | Knoerzer et al. | |
| 6,650,275 | B1 | 11/2003 | Kelly et al. | |
| 6,728,605 | B2 | 4/2004 | Lash et al. | |
| 6,992,586 | B2 | 1/2006 | Rosenfeld | |
| 7,096,173 | B1 | 8/2006 | Rappaport et al. | |
| 7,212,100 | B2 * | 5/2007 | Terenna | 340/309.16 |
| 7,772,986 | B2 | 8/2010 | Olson et al. | |
| 2004/0246144 | A1 | 12/2004 | Siegel et al. | |
| 2006/0016316 | A1 | 1/2006 | Madon et al. | |
| 2006/0256664 | A1 * | 11/2006 | Varon | 368/89 |
| 2010/0265086 | A1 | 10/2010 | Olson et al. | |

OTHER PUBLICATIONS

International Search Report for International Application No. PCT/US07/78637, dated May 22, 2008, Applicant: Vesstech, Inc., 12 pages.

* cited by examiner

VERBAL WARNING SYSTEMS AND OTHER AUDIBLE WARNING SYSTEMS FOR USE WITH VARIOUS TYPES OF DEVICES, CONTAINERS, PRODUCTS AND OTHER THINGS

CROSS REFERENCE TO RELATED APPLICATIONS INCORPORATED HEREIN BY REFERENCE

This application is a divisional of U.S. patent application Ser. No. 12/830,071, filed Jul. 2, 2010, which is a divisional of U.S. patent application Ser. No. 11/855,990, filed Sep. 14, 2007, and claims the benefit of U.S. Provisional Patent No. 60/845,454, filed Sep. 18, 2006, all of which are incorporated herein in their entireties by reference.

TECHNICAL FIELD

The following disclosure relates generally to verbal warning labels and other audible warning systems.

BACKGROUND

Warning labels attached to various objects have been used for many years in an attempt to alert users to potential hazards associated with use of the objects. Warning labels can be found on virtually any type of product, container, packaging and/or supplemental materials included with a product. For example, a bottle containing a cleaning material can include one or more written warning labels regarding potential dangers associated with the use of the product, instructions in the case of an accident, etc.

One challenge associated with warning labels is the tendency of users to ignore them. Conventional warning labels frequently include a vast amount of information in a relatively small space. Accordingly, the text on the warnings can be printed in a relatively small font that may be difficult for some users to read. A further challenge associated with written warning labels is that they fail to accommodate illiterate or visually impaired users. Moreover, in the United States, these warnings are typically written in English, thus failing to accommodate non-English literate persons.

One approach to overcoming the foregoing challenges is to include bright colors and graphical symbols on the warning label. Although bright colors and symbols may help direct attention to a warning label, there are often multiple warning labels for virtually every product in use. As such, users can experience warning label fatigue and remain unaware of the warning labels or disregard them. Moreover, warning labels are frequently removed by users or visually obscured during use or after installation. For these reasons, warning labels may not be performing their intended functions.

SUMMARY

The following summary is provided for the benefit of the reader only, and is not intended to limit the invention as set forth by the claims in any way.

The present disclosure is directed generally to verbal warning labels and other audible warning systems associated with various objects and devices, such as products, packaging, user-operable devices and appliances, electronic devices, etc. An audible warning system configured in accordance with one aspect of the invention announces a verbal warning relating to an object associated with the audible warning system. The verbal warning includes standardized information (e.g., a standardized safety warning) that is supplied and/or prerecorded by a manufacturer, supplier, distributor, retail vendor etc. of the object. As such, in certain embodiments an end user of the object cannot change or alter the content of the verbal warning. The verbal warning that is announced or otherwise audibly output by the system is a pre-event warning such that the verbal warning precedes a use of the object or other event involving the object, including accidental events and events with undesirable or unintended consequences. The verbal warning can include safety or cautionary information associated with the object for anyone coming into contact with or using the object. The audible warning system accordingly alerts, informs or otherwise warns users of potential dangers associated with the object. In certain embodiments, the audible warning system is carried by or included with a standardized warning label associated (e.g., attached) with the object. The verbal warning system can therefore supplement the warning label, or in some embodiments it can replace the warning label. Moreover, in certain embodiments the audible warning system is configured such that it can be silenced or otherwise disabled. The verbal warning system can be powered by any suitable power source, including for example, a battery, AC line power, solar power, fuel cells and/or other power sources.

A verbal warning system configured in accordance with another aspect of the invention includes a device having a standardized textual warning associated therewith. The system further includes a sound playback device operably coupled to the device and configured to audibly output a verbal warning corresponding to the textual warning. The verbal warning is provided by at least one of a manufacturer, supplier, distributor or retail vendor of the device, or other interested party. The verbal warning can supplement or replace the standardized textual warning. In certain embodiments the standardized textual warning is displayed on the device. In other embodiments, however, the standardized textual warning may not be displayed on the device.

A product container configured in accordance with another aspect of the invention includes a body having an opening associated with an interior portion, and a cover positioned proximate to the opening. The cover is movable between a first position in which the interior portion is inaccessible via the opening and a second position in which the interior portion is accessible via the opening. The container also includes a product disposed within the interior portion and an audible warning system operably coupled to at least one of the body and the cover. In this aspect of the invention, the audible warning system is configured to announce a verbal warning relating to use of the product. In one embodiment, the audible warning system announces the verbal warning in response to movement of the cover from the first position to the second position.

A user-operable appliance configured in accordance with another aspect of the invention includes an on-off control for activating and deactivating the user-operable appliance. The appliance also includes an audible warning system having a processor operably coupled to the on-off control and a data storage medium operably coupled to the processor. In one aspect of this embodiment, the data storage medium contains a spoken warning relating to use of the appliance. The audible warning system also includes a speaker operably coupled to the processor. In one embodiment, the processor causes the speaker to audibly output the spoken warning in response to receiving a signal from the on-off control associated with activation of the appliance.

A multimedia electronic device configured in accordance with a further aspect of the invention includes a body and an on-off control attached to the body. The device also includes a controller and a memory contained within the body. The controller is operably coupled to the on-off control and the memory is operably coupled to the controller. In one aspect of this embodiment, the memory contains video content and/or audio content. The audio content can include a verbal warning relating to use of the device. The device further includes a display attached to the body and operably coupled to the controller. In one embodiment the controller causes the display to present at least a portion of the video content in response to a signal from the on-off control associated with activation of the device. The device further includes a speaker operably coupled to the controller. In one aspect of this embodiment, the controller causes the speaker to broadcast the verbal warning in response to the signal from the on-off control before broadcasting other audio content on the memory.

A consumer electronic device configured in accordance with another aspect of the invention includes a computer readable medium containing instructions that cause the device to play audio content. The instructions further cause the device to play a standardized verbal warning prior to playing the audio content. In certain embodiments, the verbal warning is supplied by at least one of a manufacturer, supplier, distributor or retail vendor of the device, or other interested party.

A warning label configured in accordance with a further embodiment of the invention includes a body having a display area for presenting standardized safety information. The standardized safety information includes at least one of textual or graphical content. The standardized safety information can be supplied by one or more of a manufacturer, supplier, distributor or retail vendor of the label, or other interested party. The warning label also includes an audible warning system carried by the body. The audible warning system is configured to audibly output a verbal warning corresponding to at least a portion of the standardized safety information.

DETAILED DESCRIPTION

The following disclosure describes audible warning systems associated with various types of containers, appliances, electronic devices, and other objects. In one embodiment, for example, a container includes an audible warning system to supplement or replace a printed warning label displayed on the container. Certain details are set forth in the following description and in FIGS. 1A-12 to provide a thorough understanding of various embodiments of the invention. Other details describing well-known structures and systems often associated with warning labels, audio systems, and associated components, however, have not been set forth in the following disclosure to avoid unnecessarily obscuring the description of the various embodiments of the invention.

Many of the details and features shown in the Figures are merely illustrative of particular embodiments of the disclosure. Accordingly, other embodiments can have other details and features without departing from the spirit and scope of the present disclosure. In addition, those of ordinary skill in the art will appreciate that further embodiments can be practiced without several of the details described below. Moreover, in the embodiments described herein and illustrated with reference to FIGS. 1A-12 the containers, products, devices, appliances etc. and various components are shown schematically for the purpose of illustration. Accordingly, and as will be appreciated by one of ordinary skill in the art, the various embodiments can include other structures and/or configurations than those illustrated in the Figures and are expressly not limited to the structures shown in the Figures.

In the Figures, identical reference numbers identify identical, or at least generally similar elements. To facilitate the discussion of any particular element, the most significant digit or digits of any reference number refer to the Figure in which that element is first introduced. For example, element 110 is first introduced and discussed with reference to FIG. 1.

Figure 1A:
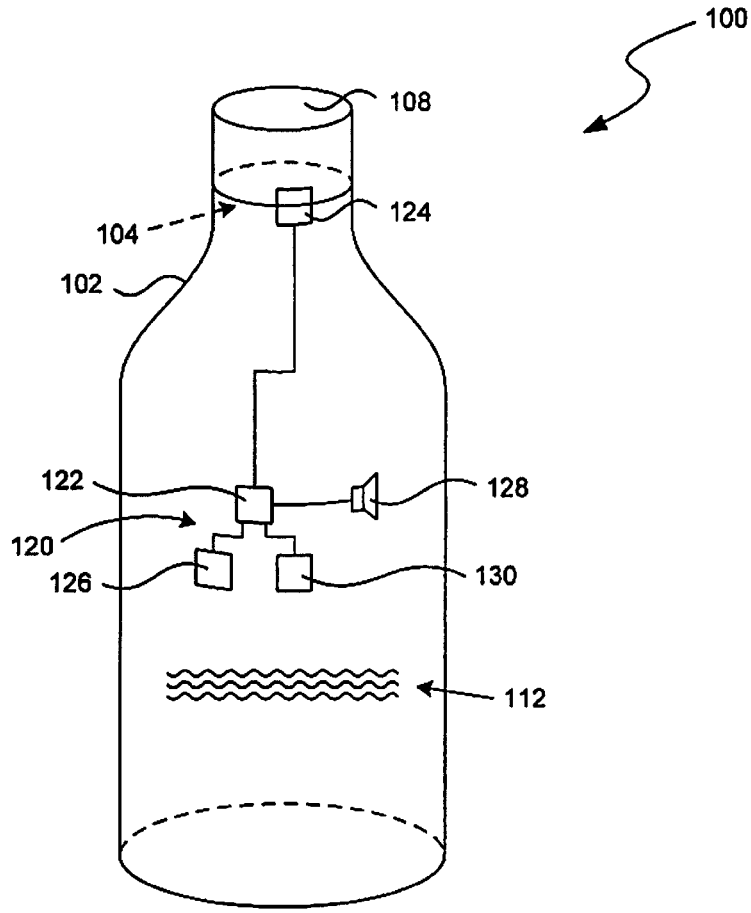
FIG. 1A is a schematic isometric view of a container including an audible warning system configured in accordance with an embodiment of the invention.
Figure 1B:
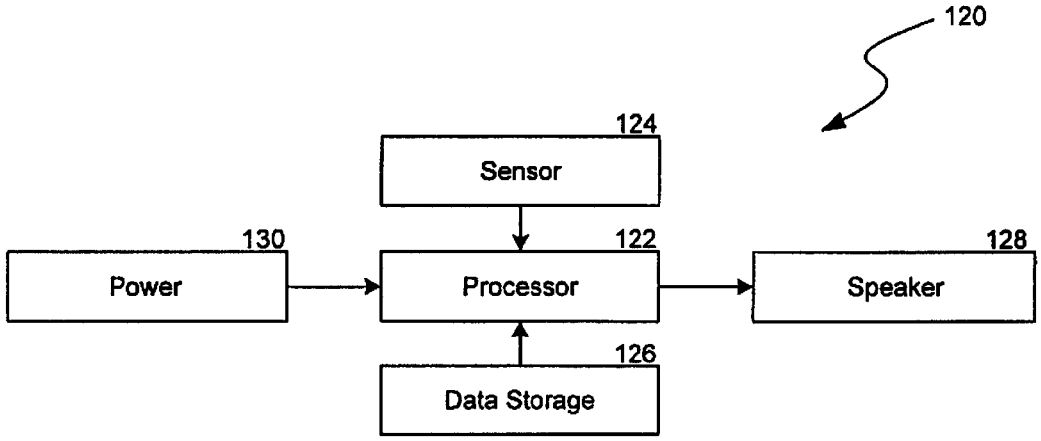
FIG. 1B is a schematic diagram of the audible warning system associated with the container of FIG. 1A, configured in accordance with an embodiment of the invention.

FIG. 1A is a schematic isometric view of a product container 100 having an audible warning system 120 configured in accordance with an embodiment of the invention. FIG. 1B is a schematic diagram of the audible warning system 120 of FIG. 1A. Referring to FIGS. 1A and 1B together, the audible warning system 120 is carried by a container body 102. The body 102 includes an opening 104 (indicated by a broken line) that provides access to an interior portion 106. An enclosure member or cover 108 is removably positioned proximate to the opening 104. The cover 108 is moveable between a closed position (e.g., as illustrated in FIG. 1), and an open position to provide access to the interior portion 106 via the opening 104. As described in more detail below, the audible warning system 120 can audibly output a warning relating to use of a product 112 disposed in the interior portion 106 of the body 102. In some embodiments, the audible warning system 120 can announce or broadcast a verbal or spoken warning.

In the embodiment of FIG. 1A, the container 100 is a bottle and the product 112 can be a liquid. In other embodiments, however, the container 100 and/or the product 112 can include other shapes, structures and/or configurations. For example, the product 112 can include a consumer product, commercial product, edible product, and/or be in a liquid, solid and/or gaseous state. In various embodiments, the container 100 can include a bottle, box, carton, packaging container, tube, tub, bag, luggage etc. made of various different materials. Moreover, the container 100 can include containers and/or packaging for consumer products, such as bleach, cleanser, paint, stain, paint thinner; for gasoline or other volatile liquids; and for food products and supplements, including alcohol, tobacco products, etc. The container 100 can also include containers and packaging materials for medical and pharmaceutical products, such as prescription and over-the-counter medicine, personal hygiene products, soaps, lotions, makeup, personal care products etc.

In the embodiments of FIGS. 1A and 1B, the audible warning system 120 includes a processor 122 (e.g., a controller, microchip, integrated circuit chip or sound playback device, or any other component that can control a sound playback function) operably coupled to a sensor 124 (e.g., a detector, switch, etc.), a data storage medium 126 (e.g., memory, recording media, etc.), a speaker 128, and a power source 130 (e.g., battery, solar cell, AC line power, electronic connector, fuel cell etc.). The processor 122 can be operably coupled to the sensor 124, the data storage medium 126, the speaker 128 and the power source 130 with wireless, wired, fiber optic and/or other links to control operation of the audible warning system 120. Although the audible warning system 120 illustrated in FIG. 1B shows the components of the system operably coupled to each other, one skilled in the art will appreciate that some or all of the components of the audible warning system 120 may be combined or included in a single component. For example, a sound playback device can include a sound chip that includes a data storage medium incorporated on the sound chip. The audible warning system 120 can be affixed to the container 100 by various methods, including, but not limited to, attaching it to the body 102 with adhesives, fasteners, etc., or embedding it within the body 102.

In some embodiments, the processor 122 can cause the speaker 128 to announce the verbal warning in response to a signal (e.g., an indication, notification, etc.) from the sensor 124. More specifically, the sensor 124 is carried by the container 100 and operably coupled to at least one of the body 102 and cover 108 to detect movement of the cover 108 from the closed position to the open position. In one embodiment, the sensor 124 can be a switch or contact including an electrical circuit path having electrical continuity when the cover 108 is in the closed position. In this embodiment, the switch can be activated (initiating input to the processor) by interrupting the electrical circuit path and switching from continuity to non-continuity when the cover 108 is moved to the open position. In other embodiments, and as described below, the sensor 124 can include other devices that implement other methods of activation. For example, the sensor 124 can be a light sensor, a touch sensor, a biometric sensor, a temperature sensor, a proximity sensor, a motion sensor, etc. Furthermore, the audible warning system 120 can include multiple sensors 124 of the same or different types positioned at different locations on the container 100.

The verbal warning can be a standardized safety message that is recorded on the data storage medium 126 by one or more of a manufacturer, supplier, distributor or retail vendor of the container 100 and/or the product 112, or any other interested party. The verbal warning can audibly warn a user of a potential hazard before it occurs, and/or supply other information to the user. In some embodiments the verbal warning is unalterable and the audible warning system 120 is not configured to allow a user to change or reprogram the verbal warning. Rather, the verbal warning can include pre-recorded safety information, such as a standardized warning, related to use of the product 112. For example, if the product 112 is a liquid that should be used in a well-ventilated area, the speaker 128 can broadcast a verbal warning stating: "Warning! This product should be used in a well-ventilated area. Do not use in enclosed areas!" In some embodiments, the verbal warning can also include a simple vocabulary and/or an exaggerated voice to grab the attention of children. For example, the verbal warning can state: "This is really yuuuuuuucky. Don't play with it or you could get really sick." In further embodiments, the data storage medium 126 can include other warnings and/or multiple warnings. In these and other embodiments, the audible warning system 120 is not required to broadcast the same verbal warning each time the container 100 is opened, thus avoiding repetition of a warning. The data storage medium 126 can include multiple verbal warnings, including for example, as many warnings as a manufacturer chooses to record or program into the system. As such, the multiple warnings could be announced sequentially, randomly, or in any other order so that the audible warning system 120 can avoid repeating the verbal warning upon activation. Moreover, the data storage medium 126 can contain a verbal warning in two or more different languages. For example, the audible warning system 120 can broadcast a first verbal warning in English followed by a second verbal warning in Spanish or some other language.

In another aspect of the foregoing embodiments, the data storage medium 126 can include other warning sounds, such as beeps, tones, chirps, buzzes or other alerting noises to supplement the verbal warning. As such, the speaker 128 can broadcast one or more alerting sounds before, during and/or after announcing the verbal warning. The processor 122 can also cause the speaker 128 to broadcast the verbal warning a total predetermined number of times and/or a predetermined number of repetitions in a specific time period. For example, the audible warning system 120 can announce the verbal warning no more than five times a day or not more than one time each hour. The audible warning system 120 can also be configured to broadcast the verbal warning in response to an indication from the sensor 124 detecting the possibility of harmful action and alert the user before the action occurs. For example, if the audible warning system 120 is associated with a container such as a pill bottle, and the user attempts to open the pill bottle more frequently than the prescribed interval between doses, the system can alert the user, for example, by stating: "Caution! Do not take more than two pills every four hours."

In further embodiments, the audible warning system 120 can be a "smart" warning system such that the processor 122 includes logic or other programming to enable additional features associated with the audible warning system 120. For example, different types of input from various sensors can be used to influence the audible warning system 120. In embodiments using a proximity sensor, for example, the audible warning system 120 can adjust the volume level of the verbal warning or other sounds output by the system based on the proximity of a user to the object carrying the audible warning system 120. If the sensor 124 is a temperature sensor, for example, it can activate the audible warning system 120 if it detects a temperature that is outside a predetermined range. For example, if a container includes a product that should not be stored above a certain storage temperature, the audible warning system 120 can alert a user if the temperature of the container exceeds the storage temperature.

In other embodiments, the "smart" audible warning system 120 can be configured to allow a user to select the language in which the verbal warning is broadcast. For example, the audible warning system 120 can include a switch or other input that allows a user to select a language to broadcast the verbal warning. In other embodiments, the audible warning system 120 can include a microphone and speech recognition capability to allow a user to select a language to broadcast the verbal warning. For example, a user can say "Español" and the audible warning system 120 will announce the verbal warning in Spanish. The audible warning system 120 and others disclosed herein can also include an activation feature that would have to be activated or enabled (e.g., pressing a button or removing a tab) before the audible warning system 120 will function. The audible warning systems 120 can also include a test feature such that a user could activate the audible warning system 120 with the test feature (e.g., by pressing a button) without actually using the object associated with the audible warning system 120. For example, a user may test the audible warning system 120 carried on a container without opening the container to determine if the audible warning system 120 is working.

In a further aspect of the illustrated embodiment, the audible warning system 120, and other warning systems disclosed herein, can be configured with additional features. For example, in certain embodiments the audible warning system 120 can have a user disable feature to disable the system after the verbal warning has been broadcast one or more times. The user disable feature can be configured such that the audible warning system can announce a warning different from the standardized warning to alert the user to the danger of disabling the audible warning system 120. For example, the audible warning system 120 can alert a user that using the disable feature will silence the audible or verbal warning at the user's own risk. In other embodiments, the audible warning system 120 can also be include a biometric sensor to detect when a different user is using the object associated with the audible warning system 120. The audible warning system 120 can accordingly be configured to announce the verbal warning for different users detected by the biometric sensor. In still further embodiments, the audible warning system 120 can include a motion sensor (e.g., a gyroscope) to detect movement of the audible warning system 120 and announce the verbal warning if an object carrying the audible warning system 120 is moving above a predetermined speed.

The embodiments of FIGS. 1A and 1B provide several advantages over conventional warning labels displayed on products or product containers. For example, the audible warning system 120 can convey a heightened sense of urgency regarding a warning of the use of the product. In some embodiments, for example, the verbal warning can convey emotion and vary the tempo of the delivery of the message to catch the user's attention. This is unlike existing warning labels attached to containers or products because users must see and read them and they are often ignored or are difficult to read. Moreover, the audible warning system 120 can also accommodate a wide variety of users, including for example, children, users that are illiterate or that have impaired sight, as well as users who speak languages other than English.

Figure 2:
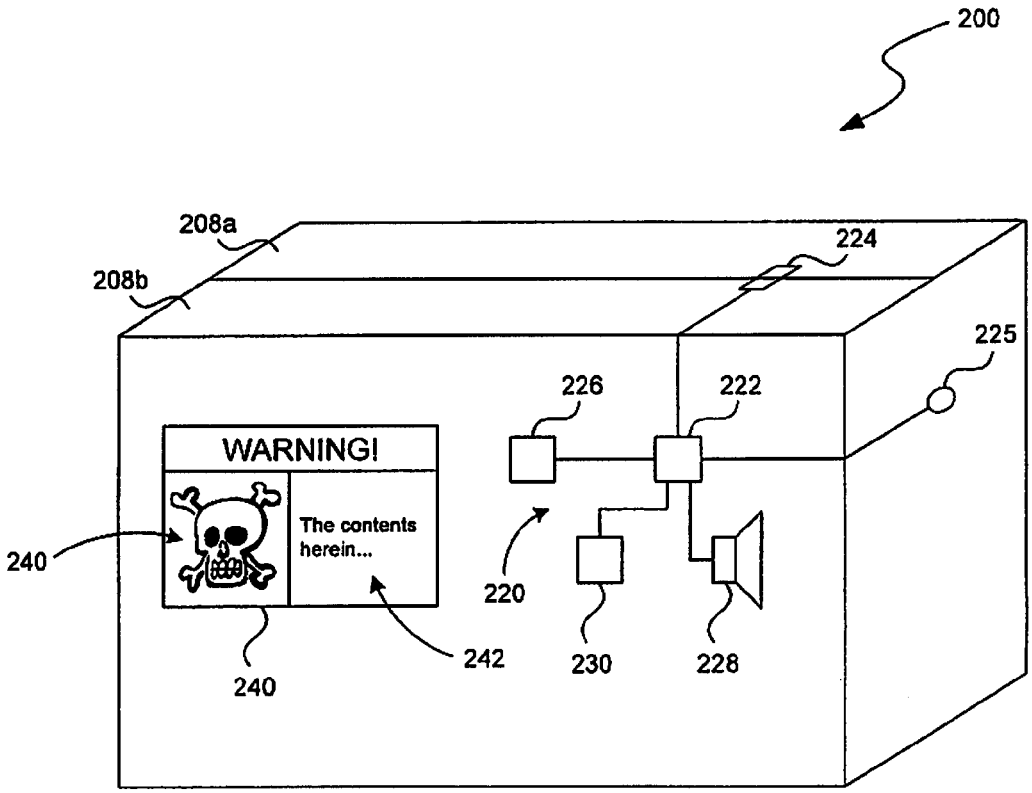
FIG. 2 is a schematic isometric view of a container including an audible warning system configured in accordance with another embodiment of the invention.

FIG. 2 is a schematic isometric view of a container 200 having an audible warning system 220 configured in accordance with another embodiment of the invention. In this embodiment, the container 200 is a box. In other embodiments, however, the container 200 can have other structures or forms, and be composed of a variety of different materials. As such, the container 200 is not limited to the illustrated rectilinear configuration. The audible warning system 220 is carried by a container body 202. Closing members 208 (identified individually as first and second closing members 208*a*, 208*b*) are pivotally attached to the body 202 to provide access to an interior portion containing a product (the interior portion of the body 202 and the product are not shown in FIG. 2).

In one aspect of this embodiment, the audible warning system 220 is generally similar in structure and function to the audible warning system 120 described above. For example, the audible warning system 220 includes a processor 222 operably coupled to a data storage medium 226, a speaker 228, and a power source 230. In this embodiment, however, the processor 222 is operably coupled to a first sensor 224 and a second sensor 225. The first sensor 224 can be generally similar to the sensor 124 described above, to detect movement of the closing members 208. In one aspect of the embodiment, the second sensor 225 can be a proximity sensor to detect the presence of an object (e.g., a user) within a predetermined distance of the sensor 225. For example, if a user comes within a specified distance (e.g., one foot) of the container 200, the second sensor 225 can initiate input to the processor 222 to announce the verbal warning.

Although FIG. 2 illustrates a first sensor 224 and a second sensor 225, the container 200 can include multiple sensors, for example, on different surfaces of the container 200 or covering specified portions of the container 200. Moreover, these sensors can include light sensors, touch sensors, motion sensors, temperature sensors, biometric sensors and/or other suitable types of sensors.

The container 200 of FIG. 2 also includes a warning label 240 attached to the body 202. The warning label 240 can include textual information 242 and graphical information 244 regarding use of the container 200 and/or product. In an aspect of this embodiment, the textual information 242 can contain a safety message and the graphical information 244 can correspond to the textual information 242. For example, if the product in the container 200 is a poisonous material, the textual information 242 can state "Warning! Contents are poisonous. Avoid contact with this product. Call poison control immediately if you contact this product. If contact occurs, thoroughly wash areas affected areas . . . [etc.]" To supplement the textual information 242, the graphical information 244 can include, for example, a skull and crossbones, which are frequently used to indicate the presence of a poisonous material.

In one aspect of this embodiment, the verbal warning contained on the data storage medium 226 can include and recite at least a portion of the textual information 242. For example, the speaker 228 can announce "Warning! Contents are poisonous." without reciting the rest of textual information 242 on the warning label 240. In other embodiments, however, the verbal warning can recite at least a portion of the textual information 242 in conjunction with other safety information not displayed on the warning label 240. For example, the verbal warning can include "Warning! Contents are poisonous. Please read warning label in case of an accident." In some embodiments, the verbal warning can also include language corresponding to the graphical information 244, such as a message describing what the graphical information 244 displays. As such, the audible warning system 220 can announce a standardized and prerecorded verbal warning corresponding to the textual and graphical information 242, 244 displayed on the warning label 240.

One advantage of the embodiment illustrated in FIG. 2 is that the audible warning system 220 can supplement or highlight aspects of the safety information contained on the warning label 240. In addition, the audible warning system 220 can also draw the user's attention towards the warning label 240. For example, for warning labels may display a relatively large amount of textual and/or graphical information that is important for safe use of a corresponding product. A Large amount of information on a warning label 240, however, can be difficult to read and/or understand. As such, the audible warning system 220 can emphasize and summarize key aspects of the warning label 240. The verbal warning can also alert a user in the event that the warning label 240 is damaged, covered up, removed or otherwise impaired.

Figure 3:
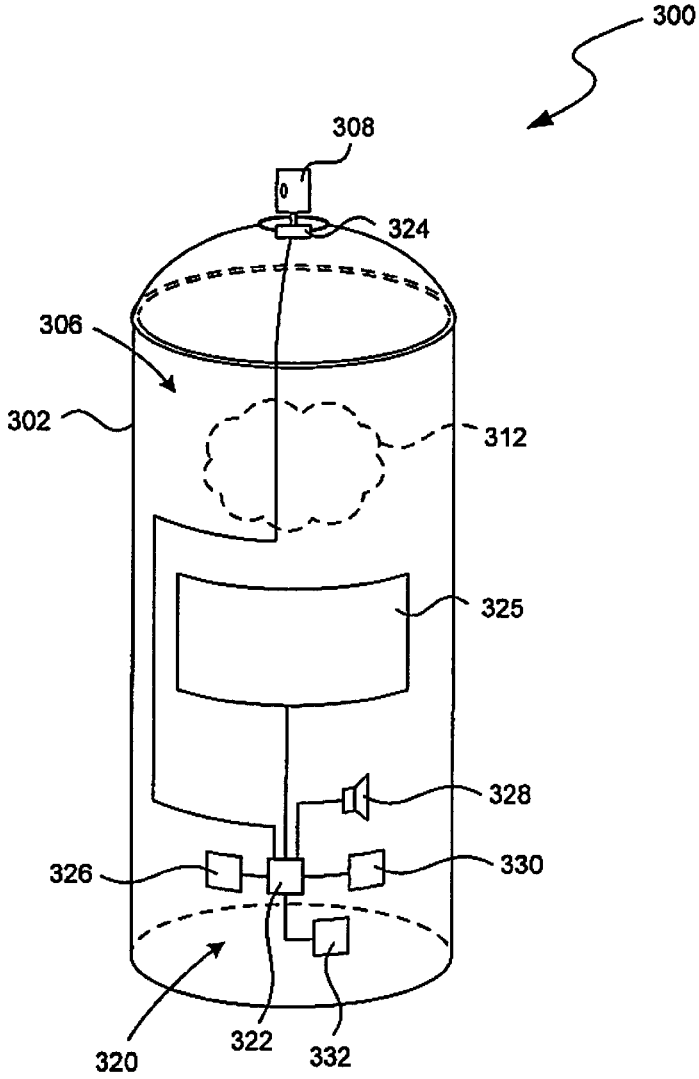
FIG. 3 is a schematic isometric view of a container including an audible warning system configured in accordance with a further embodiment of the invention.

FIG. 3 is a schematic isometric view of a container 300 having an audible warning system 320 configured in accordance with another embodiment of the invention. In this embodiment, the container 300 is a cylindrical spray can (e.g., an aerosol can) including a product 312 (e.g., a pressurized liquid or gas shown in broken lines) within an interior portion 306 of a body 302. The container 300 also includes a spray button or actuator 308 to allow the product 312 to exit the interior portion 306. The actuator 308 is moveable between a first position to retain the product 312 in the interior portion 306 and a depressed position to allow the product 312 to discharge from the interior portion 306.

In this embodiment, the audible warning system 320 is carried by the body 302 and can be generally similar in form and function to the audible warning systems described above. For example, the audible warning system 320 includes a processor 322 operably coupled to a first sensor 324, a data storage medium 326, a speaker 328 and a power source 330. In an aspect of this embodiment, the first sensor 324 is operably coupled to at least one of the body 302 and the actuator 308 to sense the position of the actuator 308. When the actuator 308 moves to the depressed position, for example, the sensor can notify the processor 322 to audibly output a verbal warning.

The audible warning system 320 of FIG. 3 also includes a touch sensor 325 operably coupled to the processor 322. The touch sensor 325 can detect contact with an object (e.g., a user's hand). In some embodiments, the touch sensor 325 can be attached to an exterior surface of the body 302 in a location where a user would likely contact the container 302, such as for example, to pick it up. The processor 322 can therefore cause the speaker 328 to announce the verbal warning in response to a notification from the touch sensor 325 associated with contact with the body 302.

The audible warning system 320 can further include a silencing control device 332 operably coupled to the processor 322. The silencing control device can function generally similar to the user disable feature described above. In some embodiments, the silencing control device 332 can be attached to the body 302 and configured to enable a user to silence or otherwise disable the audible warning system 320. The silencing control device 332 can receive an input from a user (e.g., depressing the silencing control device 332) to disable the audible warning system 320 for a specified period of time and/or number of triggering events. For example, the silencing control device 332 can disable the audible warning system 320 for a specified number of seconds, minutes, hours, days, weeks, months and/or years. In addition, the silencing control device 332 can disable the audible warning system 320 after a predetermined number of uses of the actuator 308 or contacts with the touch sensor 325. For example, after depressing the actuator 308 three times, the audible warning system 320 can be disabled or silenced. As such, the audible warning system 320 of FIG. 3 can enable a user to discontinue the broadcasting of the verbal warnings.

In certain embodiments, the silencing control device 332 of the illustrated embodiment, or other embodiments disclosed herein, can disable or silence the audible warning system 320 until a first use of the object that the audible warning system 320 is associated with. The audible warning system 320 can also be configured to be disabled or silenced until a first activation of the audible warning system 320. First activation of the audible warning system 320 can be achieved in many different ways, including for example, enabling a user, salesperson or other person to manually activate the system, removal of an object associated with the system 320 from a container, opening of a container associated with the system 320, activating a powered object for the first time, the object being associated with the system 320, etc. Subsequent to activation of the audible warning system 320, the ability to silence the system 320 and methods used to silence the system 320 can be determined by a manufacturer, distributor, retail vendor etc. In certain embodiments, the system 320 can be silenced based on recognition of a specific user. For example, different methods of user identification (e.g., voice recognition, touch recognition, user specific radio frequency identification, and other methods of biometric recognition) can be used to disable or silence the system 320 after a predetermined number of uses of the object by a specific user.

Figure 4:
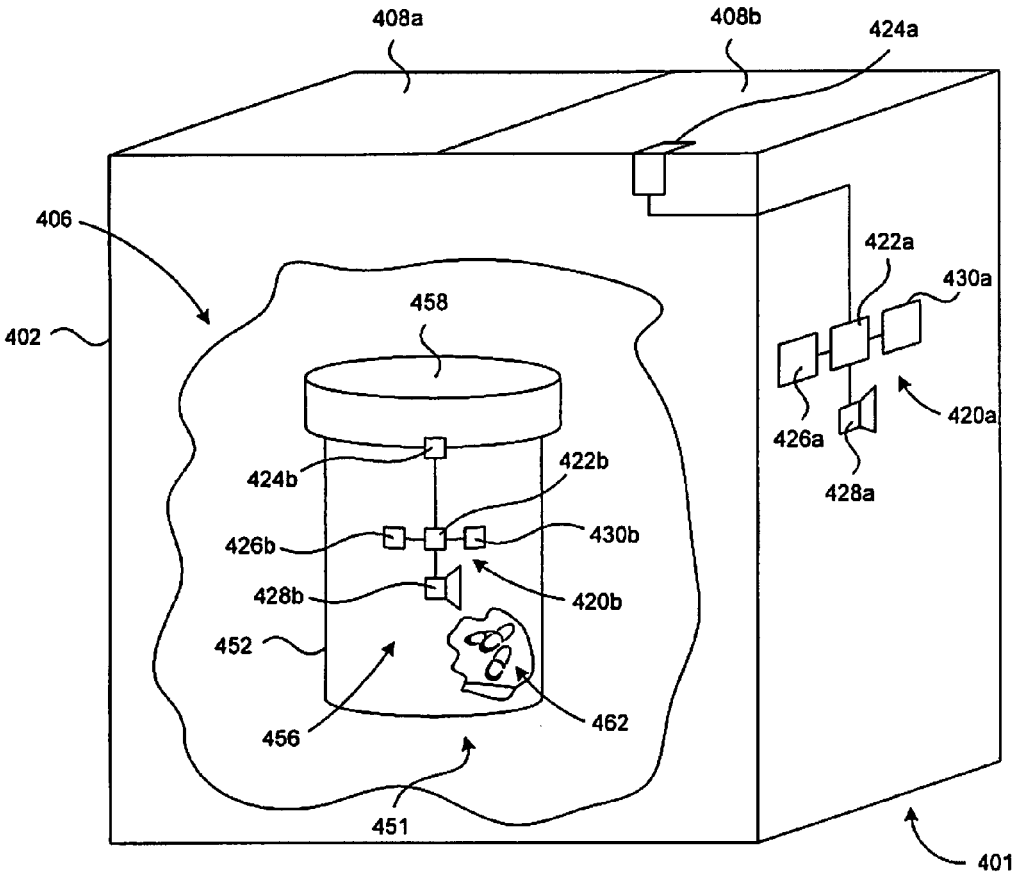
FIG. 4 is a schematic isometric view of first and second containers including audible warning systems configured in accordance with another embodiment of the invention.

FIG. 4 is a schematic isometric view of a first container 401 having a first audible warning system 420*a*, and a second container 451 having a second audible warning system 420*b*, configured in accordance with another embodiment of the invention. In this embodiment, the first container 401 is a shipping carton and the second container 451 is a bottle enclosed within an interior portion 406 of the first container 401. As will be appreciated by one of ordinary skill in the art, the first and second containers 401, 451 can include other types of containers and/or structures. The illustrated first container 401 includes a body 402 having closing members 408 (identified individually as first and second closing members 408*a*, 408*b*). The body 402 carries the first audible warning system 420*a*. The first audible warning system 420*a* can be generally similar in form and function to the audible warning systems described above. For example, the first audible warning system 420*a* includes a processor 422*a* operably coupled to a sensor 424*a*, a data storage medium 426*a*, a speaker 428*a* and a power source 430*a*. The sensor 424*a* is coupled to at least one of the body 402 and the closing members 408, and the first audible warning system 420*a* can announce the verbal warning in a manner generally similar to that described above.

The second container 451 illustrated in FIG. 4 includes a body 452 with a consumable substance 462 (e.g., pills, food, etc.) disposed within an interior portion 456. In other embodiments, however, the substance 462 is not required to be consumable. A cover 458 encloses the product 462 within the interior portion 456. The second container 451 also includes a second audible warning system 420*b* carried on the body 452. The second audible warning system 420*b* can be generally similar in form and function to the audible warning systems described above. For example, the second audible warning system can include a processor 422*b* operably coupled to a sensor 424*b*, a data storage medium 426*b*, a speaker 428*b* and a power source 430*b*. The sensor 424*b* can be operably coupled to at least one of the body 452 and cover 458.

One advantage of the embodiment of FIG. 4 is that the first audible warning system 420*a* can broadcast a first verbal warning different from a second verbal warning broadcast by the second audible warning system 420*b*. For example, the first audible warning system 420*a* can broadcast a verbal warning concerning the packaging of the second container 451 within the first container 401 (e.g., "Caution, contents may have shifted during shipment."). The second audible warning system 420*b* can announce a verbal warning relating to the dosage of a medical product 462 within the second container 451 (e.g., "Warning. Do not take more than two pills in four hours.").

Figure 5:
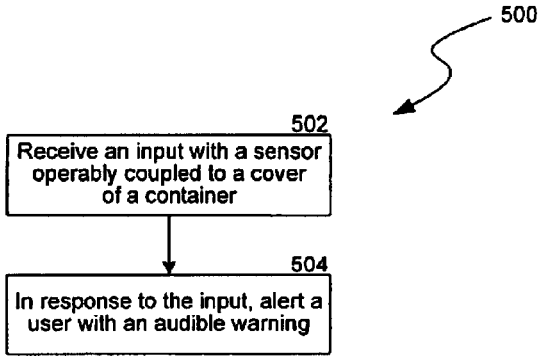
FIG. 5 is a schematic flow diagram illustrating aspects of a method of providing audio content to a user according to a further embodiment of the invention.

FIG. 5 is a schematic flow diagram of a process 500 for providing audio content to a user of a product container. In this embodiment, the process 500 includes receiving an input with a sensor operably coupled to a cover of the container (block 502). The cover can be associated with an opening in the container. The container can have an interior portion that is accessible through the opening, and the container can also have a product disposed within the interior portion. In some embodiments, receiving the input can include detecting movement of the cover from a closed position to an opening position, the open position providing access to the product. The process 500 further includes alerting a user in response to the input (block 504). Alerting a user can include broadcasting an audible warning with an audible warning system that is coupled to the container. In some embodiments, the audible warning can include a spoken safety message relating to use of the product.

Figure 6A:
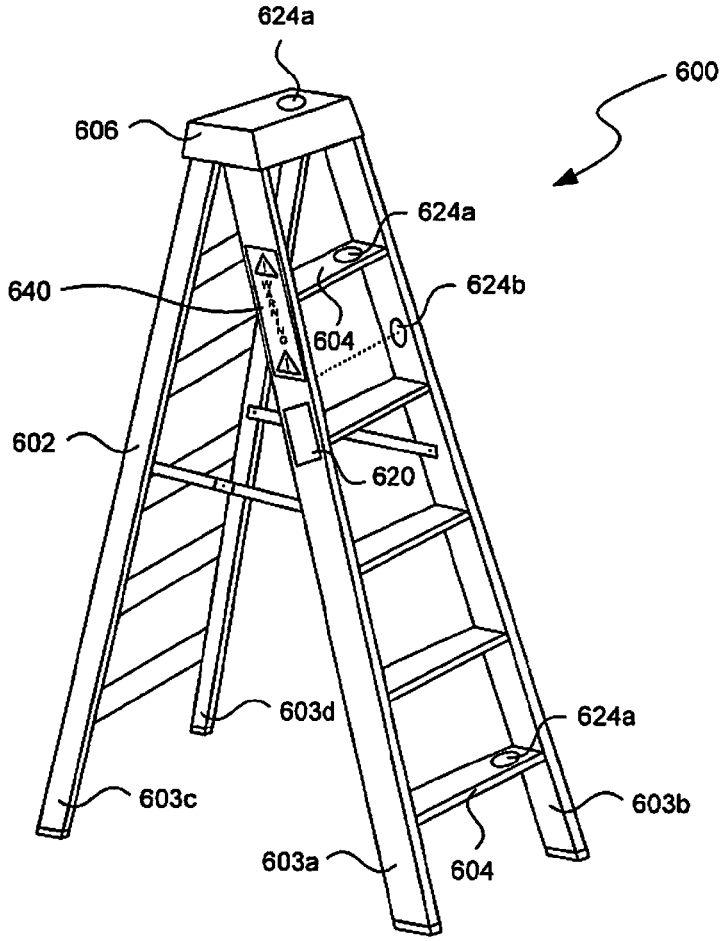
FIG. 6A is an isometric view of a user-operable device including an audible warning system configured in accordance with another embodiment of the invention.
Figure 6B:
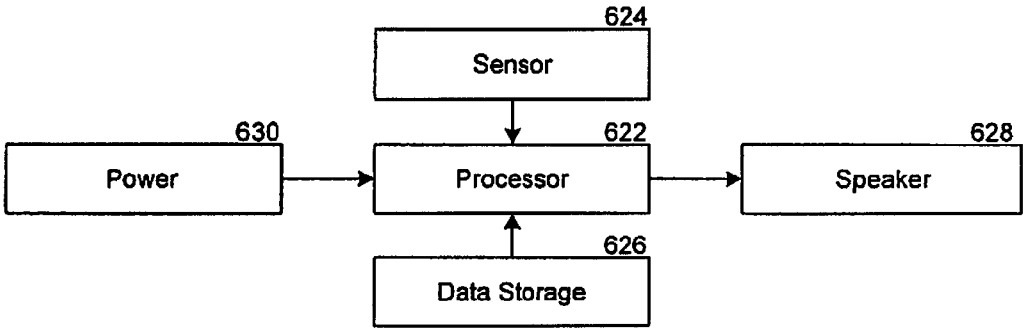
FIG. 6B is a schematic diagram of the audible warning system of FIG. 6A, configured in accordance with an embodiment of the invention.

In the embodiments described above, the audible warning systems are described as being used with various types of products and product containers. According to further embodiments of the invention, audible warning systems having many of the benefits explained above can also be used with different types of objects, such as user-operable devices, tools, appliances etc. For example, FIG. 6A is an isometric view of a user-operable appliance or device 600 having an audible warning system 620 configured in accordance with an embodiment of the invention. FIG. 6B is a schematic diagram of the audible warning system 620 of FIG. 6A. Referring to FIGS. 6A and 6B together, the device 600 is a ladder including a body 602 having a plurality of legs 603 (identified individually as first, second, third and fourth legs 603*a*-603*d*) pivotally attached to a top portion 606. The audible warning system 620 (shown schematically) is carried by the body 602, and a plurality of steps 604 extend between corresponding legs 603. The body 602 also includes a warning label 640 displayed on the first leg 603*a*. In some embodiments, the warning label can include textual information (e.g., "Danger! Do not climb above the top step!") and graphical information (e.g., a schematic figure of a person falling from the top portion 606) relating to use of the device 600. In some embodiments, the verbal warning audibly output by the audible warning system 620 can recite at least a portion of the textual information and/or correspond to the graphical information.

The audible warning system 620 (shown as a single unit in FIG. 6A) can be generally similar in form and function to the audible warning systems described above. For example, the audible warning system 620 can include a processor 622 operably coupled to a sensor 624, a data storage medium 626, a speaker 628 and a power source 630. The data storage medium 626 can include sound content including a prerecorded verbal warning including safety information related to use of the device 600.

In some embodiments, the audible warning system 620 can include multiple sensors 624 (identified individually as first sensors 624*a* and a second sensor 624*b*) at different locations on the device 600. In one aspect of this embodiment, the first sensors 624*a* can be touch sensors that are located on different steps 604. For example, touch sensors 604*a* can be positioned on the lower step 604 to generally warn the user with a safety message about the device 600 when the user contacts the first step 604. The first sensors 624*a* can also be positioned on the last step 604, as well as at the top portion 606, to provide a spoken warning to the user (e.g., that those steps are not intended to be used as a step). As the user climbs the device 600, the first sensors 624*a* can provide an indication to the processor 622 to audibly output one or more verbal warnings through the speaker 628.

In another aspect of the illustrated embodiment, the second sensor 624*b* can be a proximity sensor including a light beam 625, or other detection means, projected between the first and second legs 603*a*, 603*b*. As a user climbs the steps 604, the user's foot can trigger the second sensor 624*b* and the audible warning system 620 can announce a verbal warning (e.g., "Caution! Do not climb above this step.").

In some embodiments, the audible warning system 620 can announce multiple verbal warnings in one or more languages. The system 620 can also include any number of the sensors, data storage media and power sources described above. Furthermore, although the device 600 of FIG. 6A is a ladder, the audible warning system 620 can be included with numerous different types of user-operable devices, apparatuses, equipment, objects and the like, including non-powered and powered devices. Moreover, although the sensors 624 are shown at specific locations on the device 600, one of ordinary skill in the art will appreciate that the sensors 624 can be positioned at other locations.

Figure 7A:
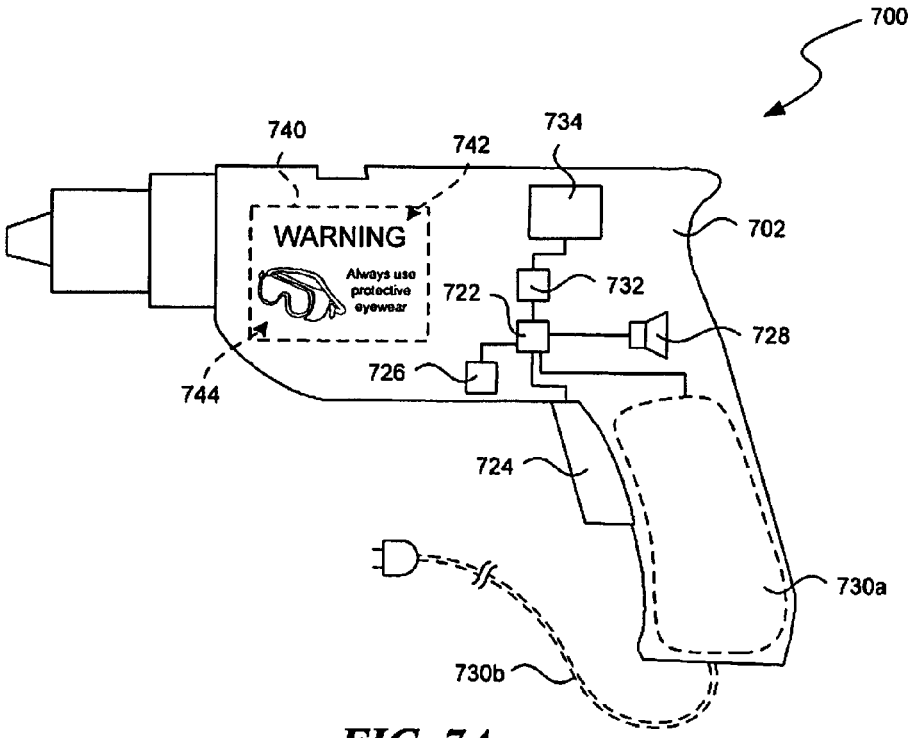
FIG. 7A is a schematic side view of a user-operable appliance including an audible warning system configured in accordance with a further embodiment of the invention.
Figure 7B:
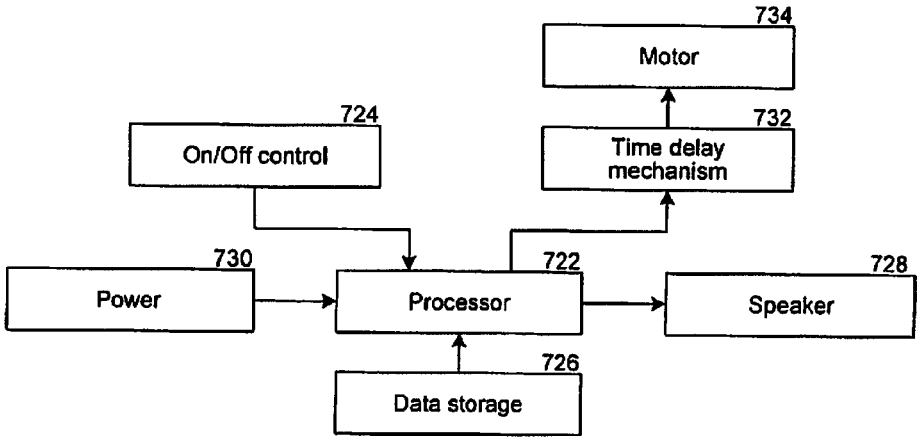
FIG. 7B is a schematic diagram of the audible warning system of FIG. 7A, configured in accordance with an embodiment of the invention.

FIGS. 7A and 7B illustrate certain features of a powered (e.g., electrically powered) user-operable device or appliance configured in accordance with another embodiment of the invention. FIG. 7A, more specifically, is a schematic side view of a user-operable appliance 700 having an audible warning system 720 configured in accordance with an embodiment of the invention. FIG. 7B is a schematic diagram of the audible warning system 720 of FIG. 7A. Referring to FIGS. 7A and 7B together, the appliance 700 is a drill having a body 702 carrying the audible warning system 720. The appliance 700 also includes an electric motor 734 within the body 702, and an on-off control 724 (e.g., activation switch, trigger, power button, etc.) for activating and deactivating the appliance 700. The appliance 700 also includes a power source 730, shown alternatively in broken lines as a battery 730*a* or a power connector 730*b*. In other embodiments, the appliance 700 can be operably coupled to other suitable power sources. For example, the audible warning system 720 can be associated with a gas powered appliance.

The audible warning system 720 can be generally similar in form and function to the audible warning systems described above. For example, the audible warning system 720 can include a processor 722 operably coupled to a data storage medium 726, and a speaker 728. The data storage medium 726 can contain sound content including a prerecorded verbal or spoken warning associated with use of the device, and/or other verbal and non-verbal sounds. In this embodiment, however, the processor is operably coupled to the power source 730 of the appliance 700. As such, the audible warning system 720 can be powered by the appliance 700 without requiring a separate power source. In other embodiments, however, the audible warning system 720 can include a power source separate from the appliance 700.

In the audible warning system 720 of this embodiment, the processor 722 can be operably coupled to the on-off control 724. In certain embodiments, the processor 722 can be configured to enable the on-off control 724 to activate the motor 734 after the verbal warning is audibly output by the audible warning system. The processor 722 can also be operably coupled to a time delay mechanism 732 and to the motor 734. In certain embodiments, the motor 734 is not activated until after the audible warning system announces the verbal warning. For example, the processor 722 can cause the speaker 728 to audibly output the verbal warning in response to a signal from the on-off control 724 associated with activating the appliance 700. The time delay mechanism 732 can activate the motor 734 after a predetermined amount of time from when the on-off control 724 was actuated. In one embodiment, for example, the time delay mechanism 732 can delay activating the appliance 700 for ten seconds while the audible warning system 720 is audibly outputting the verbal warning.

Similar to some of the embodiments described above, the appliance 700 can also display a warning label 740 on the body 702. The warning label 700 can include textual information 742 and graphical information 744 relating to safety and use of the appliance. The verbal warning audibly output by the audible warning system 720 can incorporate at least a portion of the textual and/or graphical information 742, 744. For example, the verbal warning can recite at least a portion of the textual information 742 and/or generally describe the graphical information 742.

In some embodiments, the audible warning system 720 can announce the verbal warning in response to a predetermined number of actuations of the on-off control 724. For example, after turning on the appliance 720 a predetermined number of times (e.g., twenty), the audible warning system 720 can be configured to no longer announce the verbal warning. In other embodiments, the audible warning system 720 can announce the verbal warning a predetermined number of times in a predetermined amount of time. For example, in one embodiment, the audible warning system 720 can announce the verbal warning no more than three times in one hour. In still further embodiments, the audible warning system 720 can be configured to allow a user to silence or otherwise disable the verbal warning.

Similar to the embodiments described above, the audible warning system 720 can be a "smart" system such that the processor 722 is configured to include logic or other programming features. Audible warning systems can accordingly be activated based on various types of use of an object that would appear to be contrary to the intended use of the object. The audible warning systems disclosed herein can accordingly detect the possibility of a harmful action and alert the user before the action occurs. For example, an audible warning system associated with a saw can detect a potentially dangerous hand placement prior to or during cutting with the saw. If the audible warning system senses a user's hand in a potentially dangerous placement, the audible warning system can momentarily stop the saw and warn the user about their hand placement. For example, the system can announce: "Caution! Do not hold items on the right side of the blade with your left hand. Injury may occur." In another embodiment, an audible warning system having a biometric sensor associated with a laser pointer can be configured to deliver the verbal warning no more than once every three hours (in a specific embodiment), unless the biometric sensor detects that a different person may have picked up the laser pointer.

Although FIGS. 6A and 7A illustrate specific embodiments of a user-operable device or appliance, the present disclosure is not limited to audible warning systems associated with only the illustrated embodiments. Rather, the audible warning systems and associated verbal warnings described herein can be used with numerous different types of objects, devices, apparatuses, equipment, assemblies, appliances and the like, including both non-powered and powered objects. For example, these systems can be used with, but are not limited to, home and personal appliances (e.g., kitchen appliances, heating appliances, cookware, coffee makers, toasters, cutting and food processing appliances, mixing appliances, vacuums, polishing and cleaning equipment, refrigerators, freezers, disposals, cook-tops, ranges, stoves, ovens, microwave ovens, water heaters, trash compactors, dishwashers, sewing machines, massage equipment, toothbrushes, razors, shaving equipment, battery chargers for cordless appliances, etc.); heating and ventilation equipment (e.g., portable and stationary heaters, fans, air conditioners, central heating and air conditioning systems, etc.); industrial and process equipment (e.g., machine tools, milling machines, conveyors, processing equipment, air compressors, valves, welding equipment, turbines, pumps, motors, engines, generators, etc.); outdoor appliances (e.g., barbeques, grills, radiant heaters, lawnmowers, blowers, trimmers, clippers, edgers and other lawn and garden equipment, etc.); outdoor equipment (e.g., camping, hiking, backpacking and survival equipment, hang gliders, parachutes, playhouses, swings, swing sets, children's outdoor gyms, climbers, slides, trampolines, hot tubs, whirlpools, fountains, wading pools, slip-n-slides, swimming pools, etc.) manual and power tools (e.g., table saws, circular saws, miter saws, drills, routers, sanders, joiners, planers, painting equipment and sprayers, nail guns, staple guns, riveters, screwdrivers, welding equipment, torches, soldering equipment, polishers, heat guns, glue guns, etc.); household and commercial furnishings and fixtures (e.g., plumbing and electrical systems, electrical products, lighting, lamps, furniture, etc.); baby, infant and toddler care products (e.g., strollers, cribs, walkers, jumpers, swings, mobiles, car seats, infant seats, diapers, lotions, powders, etc.); office products and equipment (e.g., paper shredders, copy machines, computers, printers, paper cutters, etc.); exercise equipment and sporting goods (e.g., guns, knives, hatchets, axes, archery equipment, treadmills, cross trainers, stair climbing machines, stationary and non-stationary bicycles, resistance training machines, free weights, stretching equipment, scales, etc.); alternative transportation (e.g., all terrain vehicles, motorcycles, boats, personal watercraft, scooters, skateboards, etc.); and automobiles (e.g., cars, trucks, sport utility vehicles, vans, motor homes etc.). The above identified examples are intended to be merely illustrative and in no way exhaustive of the types of devices and apparatuses that would benefit from the audible warning systems disclosed herein.

Figure 8:
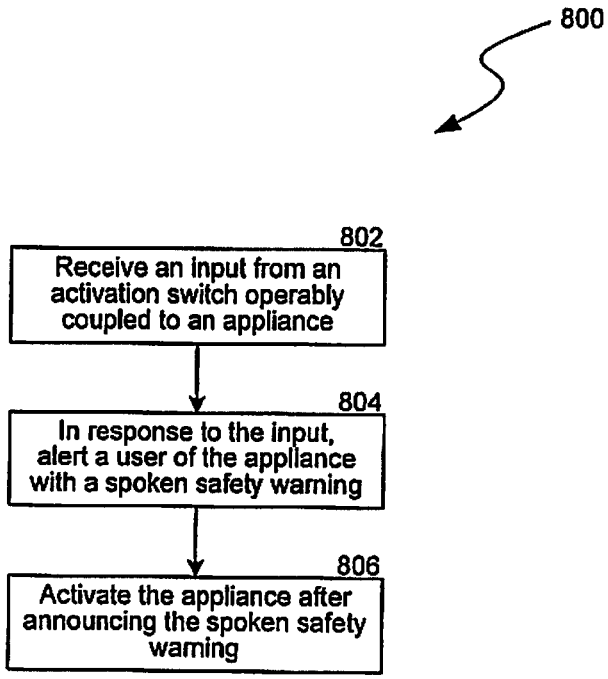
FIG. 8 is a schematic flow diagram illustrating aspects of a method of providing audio content to a user according to another embodiment of the invention.

FIG. 8 is a schematic flow diagram of a process 800 for providing audio content to a user of an electrical appliance. In this embodiment, the process 800 includes receiving an input from an activation switch operably coupled to the appliance (block 802). The activation switch can have a first position for activating the appliance and a second position for deactivating the appliance. The input can correspond to moving the activation switch from the second position to the first position. In response to the input, the process 800 further includes alerting a user of the appliance with a spoken safety warning (block 804). Alerting the user can include announcing the spoken warning with an audible warning system carried by the appliance and operably coupled to the activation switch.

The process 800 further includes activating the appliance after announcing the spoken safety warning (block 806).

Figure 9A:
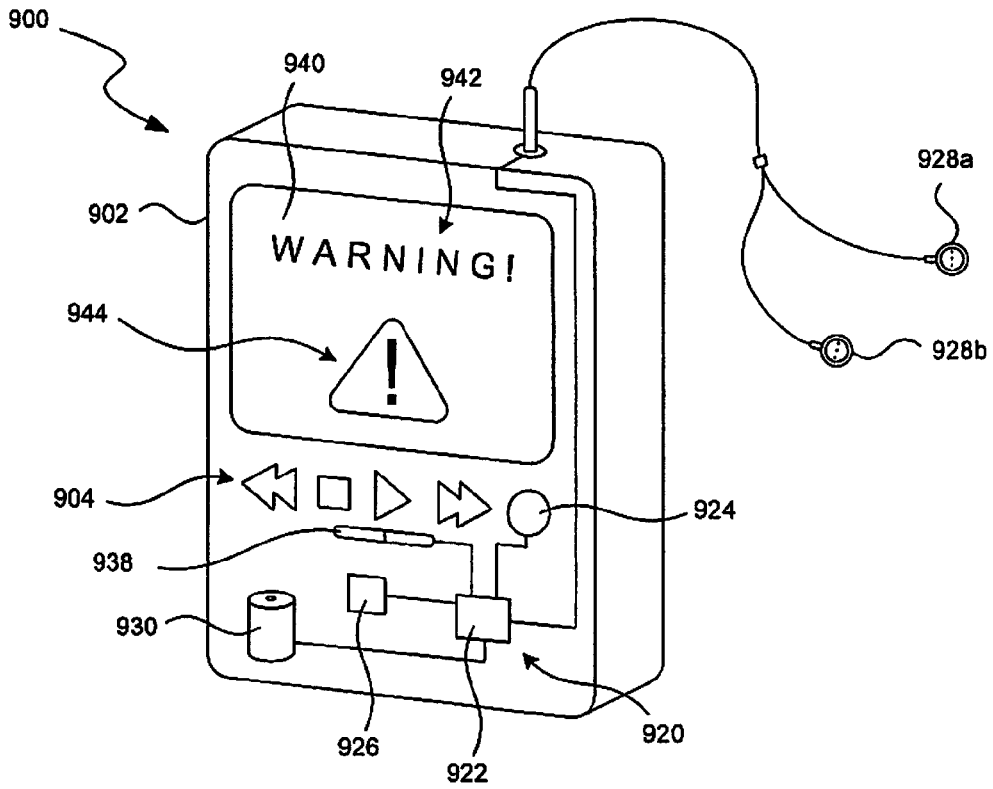
FIG. 9A is a schematic isometric view of an electronic device including an audible warning system configured in accordance with a further embodiment of the invention.
Figure 9B:
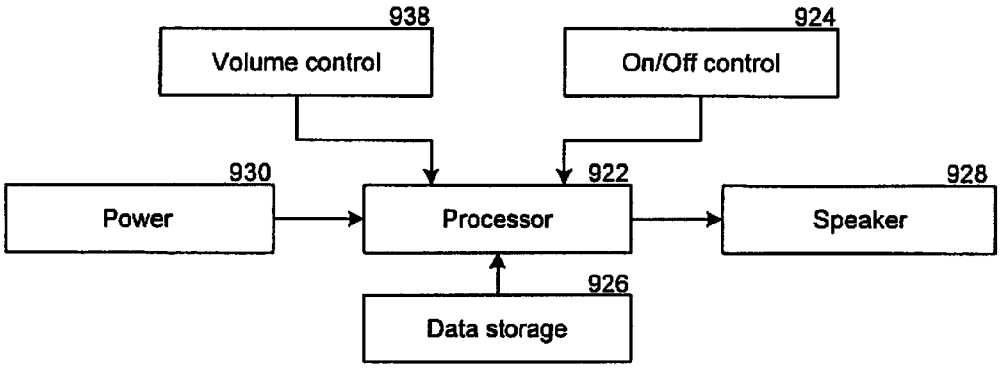
FIG. 9B is a schematic diagram of the audible warning system of FIG. 9A, configured in accordance with an embodiment of the invention.
Figure 10:
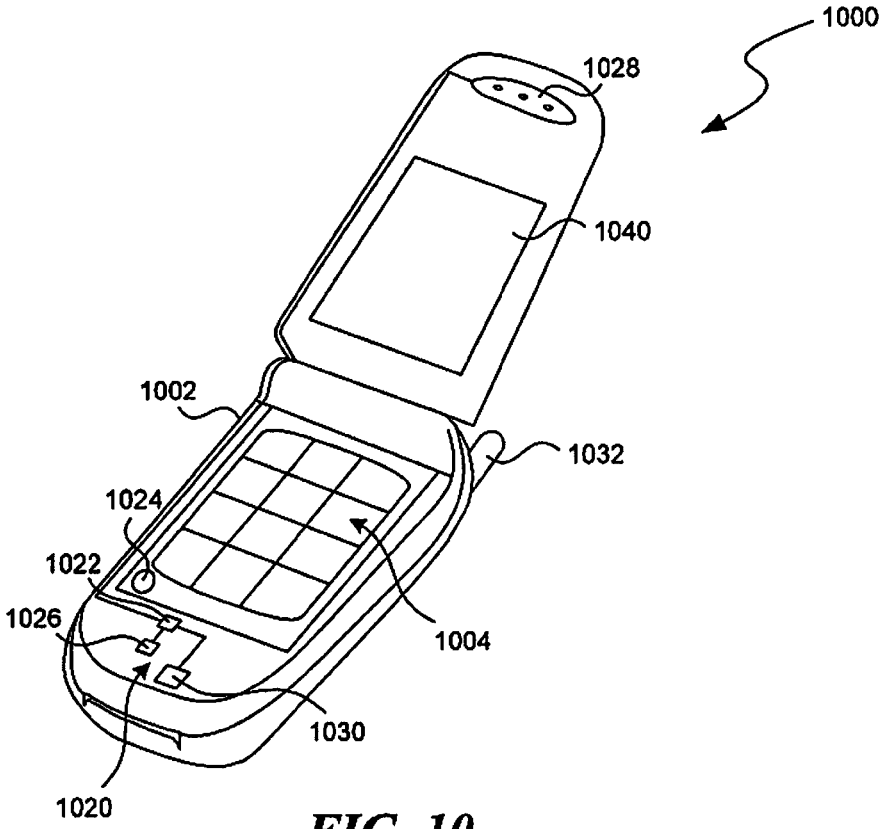
FIG. 10 is a schematic isometric view of a communication apparatus including an audible warning system configured in accordance with a further embodiment of the invention.

FIGS. 9A-10 illustrate audible warning systems incorporated into devices having pre-existing sound playback capabilities. Accordingly, the software and/or processing components of such devices can be configured to audibly output a verbal warning when satisfying one or more predetermined criteria (e.g., turning on the device or listening to the device at or above a certain sound level). FIG. 9A, more specifically, is a schematic isometric view of an electronic device 900 having an audible warning system 920 configured in accordance with a further embodiment of the invention. FIG. 9B is a schematic diagram of the audible warning system 920 of FIG. 9A. Referring to FIGS. 9A and 9B together, the illustrated device 900 is a portable media player (e.g., music and/or video player) including a body 902 carrying the audible warning system 920. The device 900 also includes various user input buttons 904 for controlling the device and a display 940 for presenting video content. The device 900 further includes a speaker 928 (identified individually as first and second speakers 928*a*, 928*b*). The illustrated first and second speakers 928*a*, 928*b* are earphones, however in other embodiments the device 900 can include a speaker permanently attached to the body 902.

The audible warning system 920 of FIGS. 9A and 9B can be generally similar in form and function to the audible warning systems described above. For example, the audible warning system 920 can include a processor 922 operably coupled to each of an on-off control 924, a data storage medium 926, a speaker 928 and a power source 930. The data storage medium 926 can contain video content and/or audio content, and include a verbal warning relating to use of the device 900. For example, when a user turns on the device 900, the audible warning system 920 can announce the verbal warning. Although not shown in FIGS. 9A and 9B, the audible warning system 920 can also include a time delay mechanism, similar to that described above with reference to FIGS. 7A and 7B, to audibly output the verbal warning before the device 900 functions.

In some embodiments, the video content (e.g., safety information) in the data storage medium 926 can include textual information 942 and/or graphical information 944 relating to use of the device and corresponding to the verbal warning. For example, when the device 900 is activated, the display 940 can present the textual and/or graphical safety information 942, 940 to a user, in conjunction with the verbal warning announced by the audible warning system 920. The verbal warning can recite at least a portion of the textual information 942 and/or correspond at least in part to the graphical information 944.

In another aspect of this embodiment, the audible warning system 920 can include a volume control 938 operably coupled to the processor 922. The volume control 938 can increase or decrease the volume of sound output by the speakers 928*a*, 928*b*. In certain embodiments, the audible warning system 920 can announce a verbal warning corresponding to a specific sound level. For example, if a user adjusts the volume to a predetermined sound level, the speaker 928 can announce a spoken warning corresponding to that sound level (e.g., "Warning! Prolonged listening at this volume level may cause hearing damage."). The verbal warning can also include safety information relating to different uses of the device 900.

One benefit of this embodiment is that some of the components of the audible warning system 920 can be components that are already incorporated into the functionality of the device 900. This differs from at least some of the embodiments described above in that the audible warning system 920 can be incorporated into devices having pre-existing audible output capabilities without requiring additional components. For example, the data storage medium 924 can include the verbal or spoken warning in addition to the sound and video content associated with the device 900. Moreover, the first and second speakers 928*a*, 928*b* can be used to announce the verbal warning in addition to outputting music or other sounds to a user. In addition, the power source 930 can include a rechargeable battery to provide power to the device 900 such that the audible warning system 920 does not require a separate power source. Accordingly, in certain embodiments the software and/or programming of the electronic device 900 can include instructions to audibly output the verbal warning using the pre-existing hardware and/or other sound playback capabilities of the device 900. For example, the device 900 or others described herein may include a computer readable medium containing instructions causing the device to play the verbal warning as well as other audio and/or video content associated with the device 900.

Another benefit of this embodiment and other embodiments described herein is that the audible warning system 920 can audibly output a verbal warning to a user where no warning label may be originally associated with an object. Cell phones, portable music players, and many other objects may be too small to display a warning label. Warning labels may also be undesirable on these types of objects for aesthetic reasons. Accordingly, the audible warning systems disclosed herein can provide safety information associated with an object that is not displayed on the object. For example, in certain embodiments the audible warning system can include information that is included in a user's manual associated with the object. Accordingly, the audible warning system can alert a user to information included in a user manual or other supplemental text that a user may not read or even be aware of.

FIG. 10 is a schematic isometric view of a communication apparatus 1000 having an audible warning system 1020 configured in accordance with still another embodiment of the invention. The illustrated communication apparatus 1000 is a cell phone. As will be appreciated by one of ordinary skill in the art, the communication apparatus 1000 can include other apparatuses, devices, structures, etc. The apparatus 1000 includes a body 1002 carrying the audible warning system 1020. The apparatus 1000 can also include input area 1004 to receive input from a user, an antenna 1032 to receive an audio and/or video signal, and a display 1040 to present video content to a user.

The audible warning system 1020 can be generally similar in form and function to the audible warning systems described above. For example, the audible warning system 1020 can include a processor 1022 operably coupled to each of an on-off control 1024, a data storage medium 1026, a speaker 1028 and a power source 1030. The audible warning system 1020 can audibly output a verbal warning including safety information associated with use of the apparatus 1000. In some embodiments, the audible warning system 1020 can announce more than one verbal warning, warnings in more than one language, and/or warnings corresponding to video or graphical content presented on the display 1040. The verbal warning can also be a standardized safety message that is unalterable by the user.

In addition to the embodiments described above, the processor 1022 can be configured to include "smart" features including logic or other programming features thus enabling the audible warning system to activate based on various types of potentially dangerous uses of an electronic device. For example, in some embodiments, the audible warning system can include a motion sensor to detect when the device is being used above a predetermined speed. As such, and in a specific embodiment, the audible warning system associated with a cell phone can alert a user that they should be using a headset while driving and talking on the cell phone. In other embodiments, the audible warning system can be activated based on different types of input.

Although FIGS. 9A and 10 illustrate specific embodiments of an electronic device and communication apparatus, respectively, the present disclosure is not limited to audible warning systems 920, 1020 combined only with the illustrated embodiments. The audible warning systems and associated verbal warnings described herein can be used with various types of electronic devices and apparatuses having pre-existing sound output capabilities, including, for example, consumer and commercial electronics, cordless phones, portable multimedia devices, global positioning and/or navigation units and systems, televisions, video recorders, video playback devices, optical and viewing enhancement equipment, PDA's, computers and computing devices, magnification and enlargement devices, game playing devices, toys, radar and laser speed detectors, projectors, laser pointers, stereos, home theater equipment, and the like.

Figure 11:
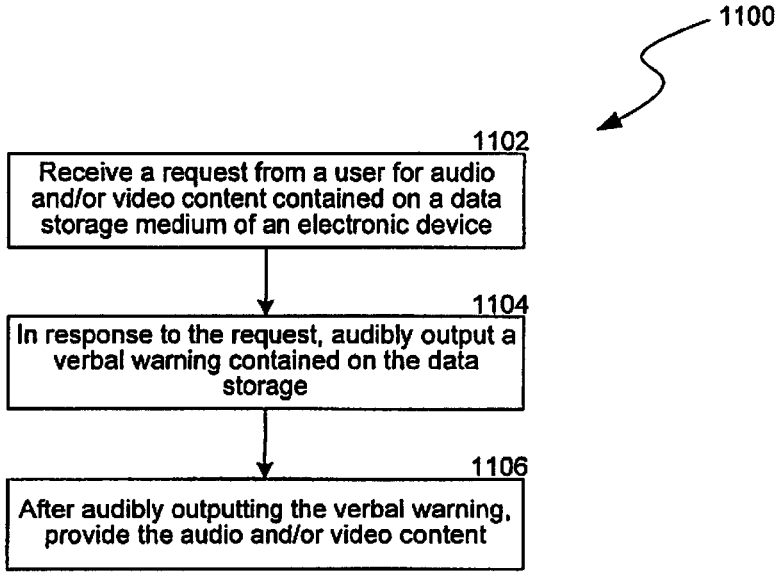
FIG. 11 is a schematic flow diagram illustrating aspects of a method of providing audio content to a user according to another embodiment of the invention.

FIG. 11 is a schematic flow diagram of a process 1100 for providing audio content to a user of an electronic device. The process 1100 includes receiving a request from a user for audio and/or video content contained on a data storage medium of an electronic device (block 1102). The process 1100 further includes audibly outputting a verbal warning in response to the request (block 1104). In some embodiments, the verbal warning can include a safety message relating to use of the electronic device. The process 1100 further includes providing the audio and/or video content after audibly outputting the verbal warning.

Figure 12:
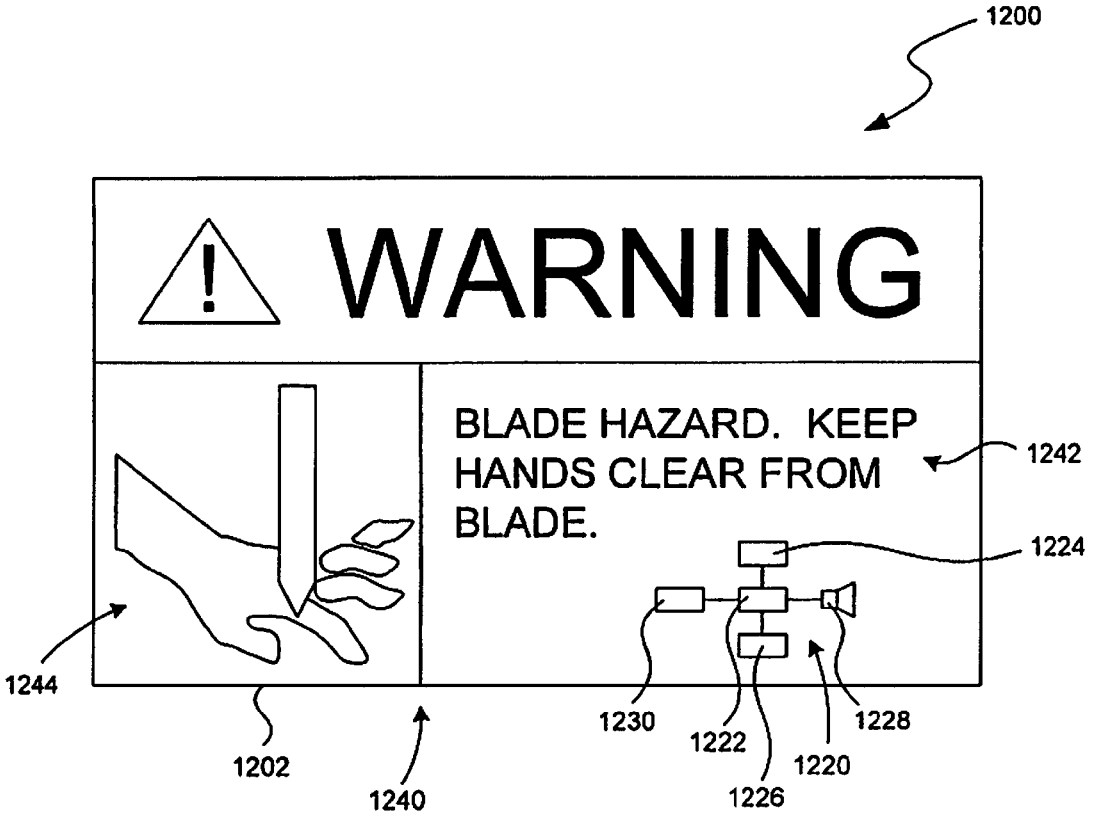
FIG. 12 is a schematic front view of a warning label including an audible warning system configured in accordance with a further embodiment of the invention.

FIG. 12 is a schematic front view of a verbal/audible warning label 1200 configured in accordance with yet another embodiment of the invention. The illustrated warning label 1200 includes a body 1202 operably coupled to an audible warning system 1220. The body 1202 can be composed of a variety of materials (e.g., laminated paper material, etc.) suitable for warning labels that are attached to various types of devices, containers, products and other things. The warning label 1200 also includes a display area 1240 for presenting standardized safety information including at least one of textual content 1242 and graphical content 1244. The textual content and/or graphical content 2142, 1244 can be supplied by one or more of a manufacturer, supplier, distributor, retail vendor or other interested party. For example, the textual and graphical content 1242, 1244 can include cautionary or safety information related to an object that the warning label 1200 is carried by. The audible warning system 1220 can be generally similar in form and function to the audible warning systems described above. For example, the audible warning system 1220 includes a processor 1222 operably coupled to a sensor 1224, a data storage medium 1226, a speaker 1228 and a power source 1230. As such, the audible warning system 1220 can audibly output a verbal warning corresponding to the information presented on the warning label 1200.

In one aspect of the illustrated embodiment, the audible warning system 1220 is carried by and included with the warning label 1200. For example, the audible warning system 1220 can be embedded in the body 1202 or attached to an interior or exterior surface of the body 1202. The warning label 1200 itself accordingly includes the verbal warning output capability. As such, an object (not shown) carrying the warning label 1200 does not have to be modified to include the components of the audible warning system 1220. Rather, these components are included with and carried by the warning label 1200.

The audible warning system 1220 can include many of the features described above, such as, for example, different types of sensors to activate the audible warning system 1220. In certain embodiments, the verbal warning can correspond at least in part to the textual and/or graphical content 1242, 1244. For example, the verbal warning can recite at least a portion of the textual content 1242 and describe at least a portion of the graphical content 1244. In other embodiments, the verbal warning can announce information that is not displayed on the warning label 1200.

The verbal/audible warning label 1200 can be attached to an object using various adhesives, fasteners (e.g., rivets, screws, bolts, etc.) or other suitable fastening means as is known in the art. In certain embodiments, the warning label 1200 is not required to include both of the textual and graphical information 1242, 1244. Moreover, the verbal warning can also include information that is not presented by the warning label 1200. Although the illustrated warning label 1200 presents information related to a cutting blade, one skilled in the art will appreciate that the warning label 1200 is merely illustrative of one type of warning label and that it may include other formats and content regarding any type of warning information.

From the foregoing, it will be appreciated that specific embodiments of the invention have been described herein for purposes of illustration, but that various modifications may be made without deviating from the spirit and scope of the various embodiments of the invention. For example, verbal warning labels and/or audible warning systems having various types of sensors can be activated based upon any possible use of an object associated with the audible warning system that would appear to be contrary to the intended use of the object. Further, while various advantages and features associated with certain embodiments of the invention have been described above in the context of those embodiments, other embodiments may also exhibit such advantages and/or features, and not all embodiments need necessarily exhibit such advantages and/or features to fall within the scope of the invention. Accordingly, the invention is not limited, except as by the appended claims.

We claim:

1. A product container, the container comprising:

a body having an opening associated with an interior portion;

a product disposed within the interior portion;

an enclosure member positioned proximate to the opening and movable between a first position in which the product is retained in the interior portion and a second position in which the product can exit the interior portion via the opening;

a sensor operably coupled to at least one of the body and the enclosure member; and an audible warning system carried by the container and operably coupled to the sensor, wherein the audible warning system is configured to audibly output a spoken warning regarding the product in response to receiving an indication from the sensor associated with movement of the enclosure member from the first position toward the second position.

2. The container of claim 1 wherein the audible warning system includes:

a controller operably coupled to the sensor;

a data storage medium operably coupled to the controller, the data storage medium containing the spoken warning;

a power source operably coupled to the controller; and a speaker operably coupled to the controller, wherein the controller causes the speaker to audibly output the spoken warning in response to receiving the indication from the sensor.

3. The container of claim 1, further comprising a warning label displayed on an exterior surface of the body, the warning label including textual information regarding use of the product, and wherein the spoken warning corresponds to at least a portion of the textual information.

4. The container of claim 1 wherein the sensor is a first sensor, the container further comprising a second sensor operably coupled to the body, wherein the controller causes the speaker to audibly output the spoken warning in response to receiving a signal from at least one of the first and second sensors.

5. The container of claim 1 wherein the sensor is a light sensor, and the indication from the sensor is associated with a change in light received by the sensor.

6. The container of claim 1 wherein the sensor is a motion sensor, and the indication from the sensor is associated with movement of the container.

7. The container of claim 1 wherein the sensor is a touch sensor, and the indication from the sensor is associated with physical contact with the sensor from a user.

8. The container of claim 1 wherein the sensor is a proximity sensor, and the indication from the sensor is associated with an object moving within a predetermined area surrounding the sensor.

9. The container of claim 1 wherein the sensor is a temperature sensor, and the indication from the sensor is associated with a detected temperature outside of a predetermined temperature range.

10. An audible warning system comprising:

a product manual having information related to a product;

a sensor operably coupled to the manual to activate the audible warning system in response to a predetermined input;

a controller operably coupled to the sensor;

a data storage medium operably coupled to the controller, the data storage medium containing a verbal warning; and a speaker operably coupled to the controller, wherein the controller causes the speaker to audibly output the verbal warning in response to a signal from the sensor associated with the predetermined input.

11. The system of claim 10, wherein the verbal warning is a first verbal warning in English and the data storage medium contains a second verbal warning in a language other than English, and wherein the controller causes the speaker to audibly output the first verbal warning and the second verbal warning.

12. The system of claim 10, further comprising an input device for receiving user input, wherein the verbal warning is a first verbal warning in English and the data storage medium contains at least one additional verbal warning in a language other than English, and wherein the controller causes the speaker to output one of the verbal warnings in response to user input that selects the language in which the verbal warning will be output.

* * * * *